United States Patent [19]

Heimaster

[11] 4,192,550

[45] Mar. 11, 1980

[54] REFLECTED LIGHT DETERMINATION OF GEOLOGICAL STRATA

[75] Inventor: John W. Heimaster, Charleston, S.C.

[73] Assignee: Coaltex, Inc., Beckley, W. Va.

[21] Appl. No.: 918,693

[22] Filed: Jun. 23, 1978

[51] Int. Cl.[2] ..... E21C 35/08

[52] U.S. Cl. ..... 299/1; 250/254

[58] Field of Search ..... 299/1; 250/253, 254, 250/255; 175/41, 50, 78

[56] References Cited

U.S. PATENT DOCUMENTS

| | | | |
|---|---|---|---|
| 2,032,509 | 3/1936 | Shanoy | 175/78 |
| 2,206,922 | 7/1940 | Smith | 175/41 |
| 2,620,386 | 12/1952 | Alspaugh et al. | 299/1 |
| 2,699,328 | 1/1955 | Alspaugh et al | 299/1 |
| 3,019,338 | 1/1962 | Monaghan et al. | 299/1 X |
| 3,102,718 | 9/1963 | Eberle | 299/1 |
| 3,294,449 | 12/1926 | Hartley et al. | 299/1 |
| 3,333,893 | 8/1967 | Heimaster | 299/1 |
| 3,371,964 | 3/1968 | Weber | 299/1 |
| 3,578,807 | 5/1971 | Barrett | 299/1 |
| 3,970,827 | 7/1976 | Ikuta et al. | 235/92 TC |
| 4,079,997 | 3/1978 | Bienko et al. | 299/1 |

*Primary Examiner*—Ernest R. Purser

*Attorney, Agent, or Firm*—Cushman, Darby & Cushman

[57] ABSTRACT

A method and apparatus for mining a desired geological strata, such as a coal seam, from surrounding undesired geological strata. A bore is formed in the coal seam in a first direction, and while progressively penetrating the coal seam with a mining machine, the distance of the mining machine from the undesired strata in a second direction perpendicular to the first direction is effectively measured. The measuring is accomplished by generating chips by boring upwardly through the coal seam toward and into the undesired strata, and reflecting light off of the chips, the difference in reflectivity between the chips from the coal and from the undesired stratum serving to indicate when the undesired stratum has been reached. The distance of upward movement of the drill from a reference until the reflectivity of the undesired stratum is detected is measured, or the thickness of the coal seam above the machine is measured, and the mining machine is controlled based upon such measurements. A single power source can be employed for both rotating the drill and reciprocating the drill in measured progress toward the undesired stratum.

27 Claims, 4 Drawing Figures

REFLECTED LIGHT DETERMINATION OF GEOLOGICAL STRATA

BACKGROUND AND SUMMARY OF THE INVENTION

The invention relates to a method and apparatus of mining a desired geological stratum from surrounding undesired geological strata, the desired and undesired strata having different properties, especially different light reflecting properties. In the mining of coal and other valuable geological strata which occur in laminar fashion (seams), it is desirable to recover as much as possible of the valuable stratum without excessive contamination from the adjacent undesired stratum. Conventionally, this is accomplished by the operator himself. The operator of a mining maching periodically steers it in the direction of the boundary between the desired and undesired strata until contact is made with the undesirable stratum, which contact can be observed by noting the appearance of the mined product. The operator then backs the mining machine off a few inches and proceeds. Such a procedure is practical where the operator can see when contact has been made.

There are many situations when it is not practical for the operator to visually observe the mining operation. In many situations, for safety reasons, it is undesirable for an operator to be within sight of the mining face. In some situations, the stratum immediately above the desired stratum is unstable, and it is necessary to leave some of the desirable stratum in place to support the unstable stratum. Also, with auger-type mining machines and the like where an operator is stationed at a point remote from the mining face, it may be several minutes before the operator, by observing the appearance of the mined product, can tell that contact with the undesired stratum has been made, and this can result in excessive contamination of the mined material.

Devices have been constructed to indicate to the operator that the undesired stratum has been contacted so that the operator need not rely on visual inspection. One such device is shown in U.S. Pat. No. 3,333,893. In such device, the difference in the reflectivity between the desired stratum (coal) and the undesired stratum is utilized to provide an indication of when the undesired stratum has been reached. An auxillary cutting tooth is provided that operates at a fixed distance beyond the periphery of the cutting head for the mining machine itself. In practice, this distance cannot exceed about one-half inch, and the mining machine can only depart from its desired path by this fixed distance before the main cutting elements of the mining machine encounter the adjacent stratum. Utilizing such a structure which determines when the undesired stratum has actually been contacted, if the line of demarcation between the desired and undesired strata is irregular (as is usually the case), the operator has very little time to react and alter the course of the mining machine to remain entirely within the desired stratum. Also, since the auxillary cutting tool must operate at the head of the mining machine, and often contacts the rough, harsh, undesired stratum for significantly long periods of time, wear of the auxillary cutting tool is excessive, and worn bits must be replaced quite frequently.

There have also been other proposals for measuring the distance between the mining machine and the boundary of the undesired stratum, but normally such devices are based on the "back-scattering" of radioactive rays, such devices being bulky and dangerous for an inexperienced operator.

According to the present invention, a method and apparatus have been provided that minimize or eliminate all of the drawbacks inherent in the prior art. According to the present invention, it is possible to measure the distance from the mining machine to the extremity of the stratum being mined, and this can be accomplished utilizing a tool a having increased wear-life compared to the prior art, and in a simple and safe manner, using the difference between the light reflecting properties of the desired and undesired strata to indicate the distance from a reference to the undesired strata.

According to one aspect of the present invention, a method of mining a desired geological stratum from surrounding undesired strata having different light reflecting properties, is provided. The method comprises the steps of boring in a first direction (horizontally) into the desired stratum with a mining machine, and progressively penetrating the desired stratum with the mining machine while measuring the distance of the mining machine from the undesired strata in a second direction (up) perpendicular to the first direction. The measuring is accomplished by taking advantage of the different light reflecting properties of the desired stratum and the surrounding undesired strata. The direction of boring is controlled based upon the received measurements so that the machine generally stays within the desired stratum. The measuring is accomplished by boring through the desired stratum toward and into the undesired strata in the second direction, to generate chips, and continuously monitoring a property of the chips that is different for the undesired strata chips than for the desired stratum chips—preferably the light reflecting characteristics of the chips. The boring is accomplished by rotating a rotary drill bit with a peripheral speed that is low—i.e., only about 50 feet per minute, compared to the peripheral speed of a cutting head which is high—i.e., about 600 feet per minute—thus resulting in little wear to the drill bit, especially since it only need contact the normally abrasive undesired strata instantaneously.

The apparatus according to the present invention comprises a mining machine having a high speed cutting head, and adapted to penetrate a geological stratum in a first direction (horizontally). Means for penetrating the desired stratum and toward and into the undesired strata in a second direction (up) generally perpendicular to the first direction is also provided, such means preferably comprising a rotary drill mounted on the mining machine posterior of the cutting head. Means are provided for measuring the distance of the mining machine from the undesired strata in the second direction, this being accomplished by utilizing a light source mounted on the machine and a reflective surface and a photocell mounted in operative relationship with the light source, the chips generated during boring in the second direction being contacted by the light emitted from the light source, and reflected to the photocell. An abrupt change in the light reflecting properties of the chips—such as occurs when the undesired stratum is contacted—causes the photocell to change its conductivity, which effects operation through solid state circuitry to automatically stop the advance of the drill and return the drill to its original position. A digital counter counts the extent of penetration of the drill, and the counter displays the distance digitally until the next cycle of operation is begun at which time it automatically resets. Utilizing such apparatus, it is possible to always remain in the desired stratum since advance warning is provided when the boundary of the desired stratum is being reached, and in this way it is possible to leave any desired amount of desired stratum overhead that is necessary for safety purposes.

It is the primary object of the present invention to provide a simple, safe, and efficient method and apparatus for maintaining a mining machine in a desired geological stratum. This and other objects of the invention will become clear from an inspection of the detailed description of the invention, and from the appended claims.

DETAILED DESCRIPTION OF THE INVENTION

Figure 1:
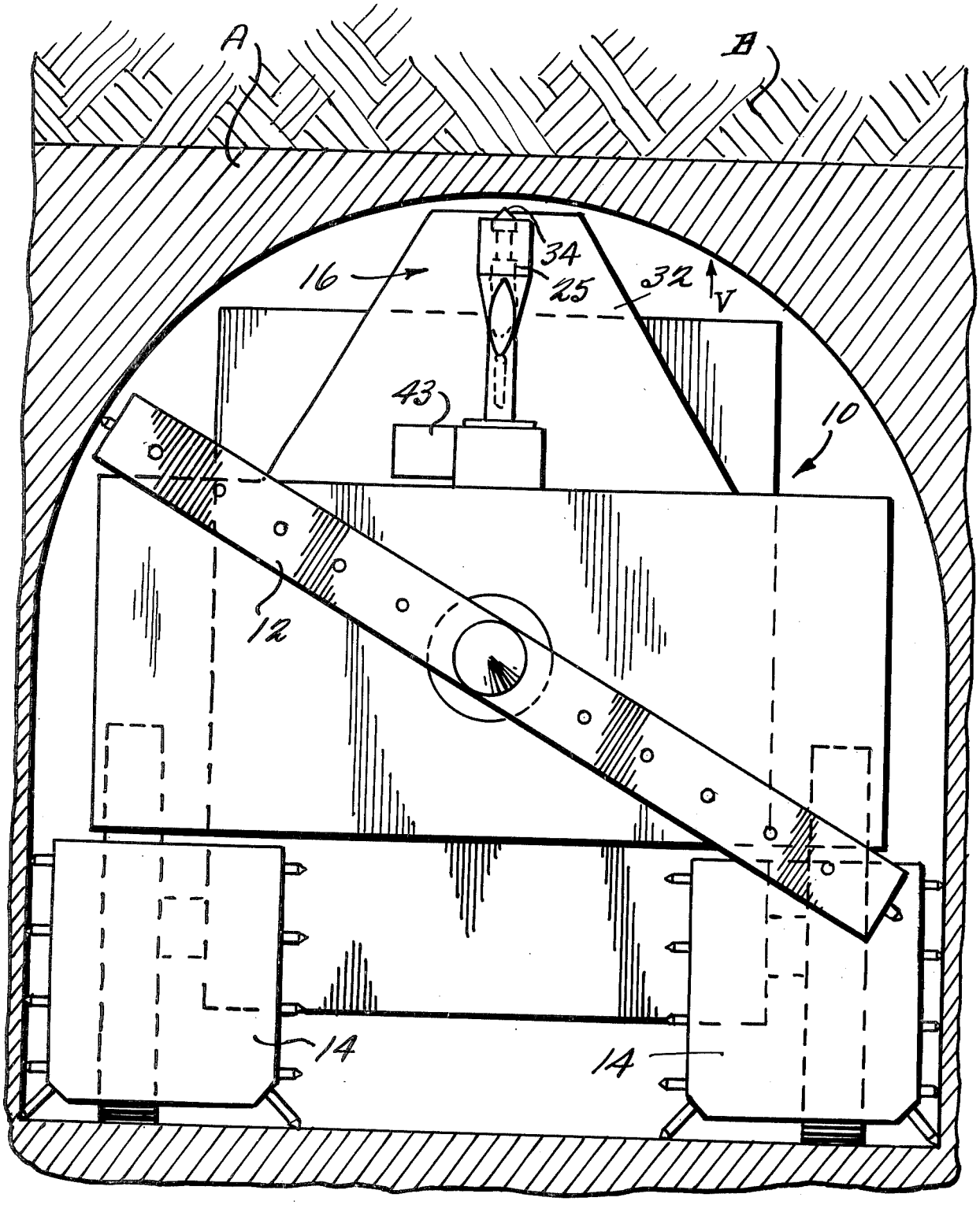
FIG. 1 is a front view of an exemplary mining machine for practicing the method of the present invention.

In the following detailed description, the desired stratum to be mined will be referred to as "coal" although a wide variety of other desired strata are within the purview of the invention; the undesired strata will be referred to as "over-burden" and can comprise a wide variety of materials; and the first direction, the direction of penetration of the mining machine, will be referred to as "horizontal", and the second direction will be referred to as "up", even though the first and second directions may be different within the purview of the invention.

An exemplary mining machine for practicing the present invention is shown generally at 10 in the drawings. The mining machine 10 includes a conventional rotatable cutting head 12 for boring horizontally, in direction H, into the coal seam and for progressively penetrating the coal seam, and wing cutters 14 also may be provided. The mining machine 10 may be of a conventional type. According to the present invention, means 16 are provided for measuring the distance of the mining machine 10 from the over-burden B in the direction V, which is generally perpendicular to direction H.

Figure 2:
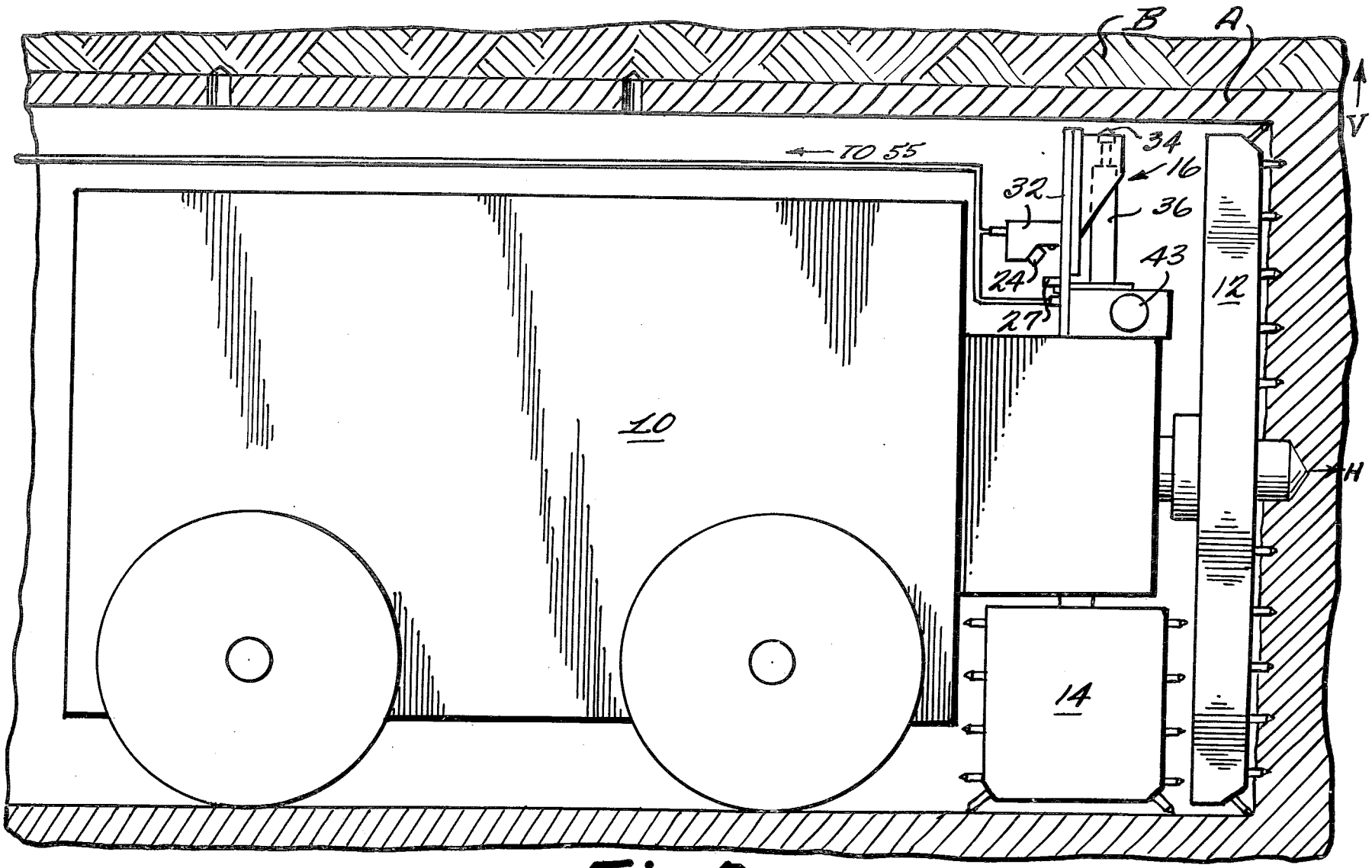
FIG. 2 is a side view of the mining machine of FIG. 1.
Figure 3:
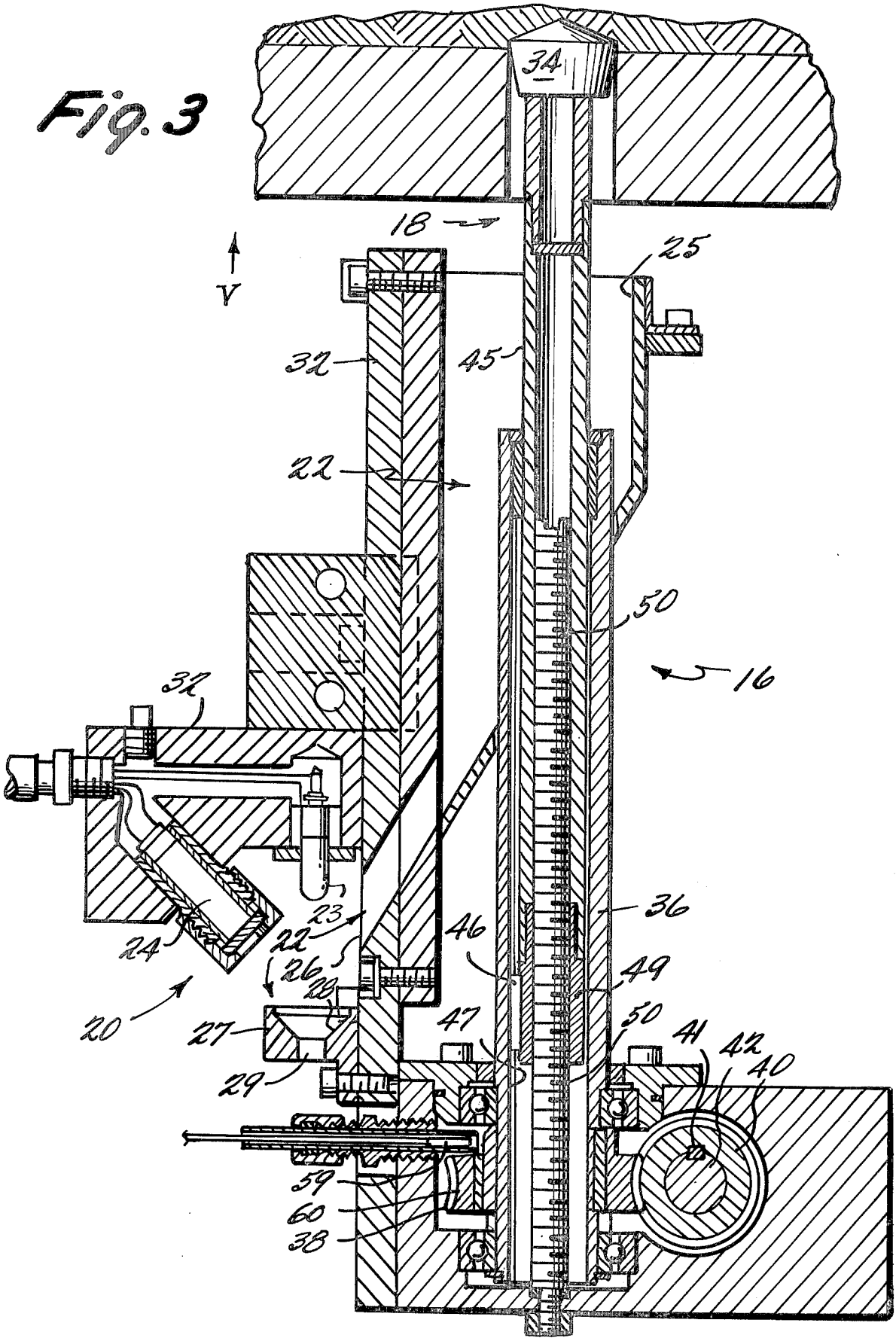
FIG. 3 is a vertical cross-sectional view of exemplary measuring apparatus according to the present invention.

The means 16, which is shown most clearly in FIGS. 3 and 2, includes means 18 for penetrating the coal A and moving toward and into the over-burden B in the direction V to generate chips, and means 20 for continuously monitoring a property of the generated chips that is different for the over-burden chips than for the coal chips. The means 20 preferably takes advantage of the difference in light reflectivity of the coal chips and the over-burden chips, and includes a chip collecting means 22, a light source 23, and light sensitive means (a photocell) 24 positioned so as to receive the light reflected off chips and the chip collecting means 22. The chip collecting means 22 includes a chips funnel 25 surrounding the penetrating means 18 for capturing chips generated thereby, and having a collecting cup 27 positioned at the termination 26 of the funnel 25. The collecting cup 27 may be of any suitable type, but preferably includes an interior reflective surface 28, and an opening 29 in the bottom to let the chips automatically fall out after being retained for a short period of time in the cup 27. All of the component parts of the means 20 are preferably mounted on a mounting plate assembly 32 which supports the apparatus and also protects the relatively fragile lamp 23 and photoconductive cell 24 from damage from flying lumps of material during the mining operation.

The penetrating means 18 preferably comprises a rotary drill, including a drill bit 34, means for rotating the drill bit 34, and means for linearly moving the bit 34 in direction V. Preferably, a single power source (43) is provided for both effecting rotating and linear movement of the bit 34.

The means for rotating the bit 34 preferably comprises a drive tube 36 which is operatively connected to the bit 34, and a gear 38 rigidly connected to the drive tube 36, a power source (43) being operatively connected to the gear 38. Preferably, the gear 38 is a worm gear, and is driven by a worm 40. The worm 40 is connected through key 41 to a power shaft 42 of a reversible motor 43. The bit 34 is operatively connected to the drive tube 36 by a drill tube 45. The drill tube 45 is preferably connected to the drive tube 36 by spline means 46, 47 which prevent relative rotational movement between the elements 36, 45, but allow relative linear movement therebetween along their axes (in direction V). The means for linearly moving the drill bit 34 preferably comprises the spline means 46, 47, and an internally threaded bushing 49 attached to the drill tube 45, and an externally threaded fixed rod 50 mounted to the mining machine 10, and concentric with the tubes 45, 36. The threads on the bushing 49 and rod 50 cooperate so that upon rotation of the tube 36—and thus the tube 45—with the rod 50 remaining stationary, the tube 45 will move linearly along the axis of the rod 50.

For convenience, it is preferred that the rod 50 has ten threads per standard length unit (i.e., ten threads per inch) so that a digital counting means provided for counting the number of revolutions of the drill bit 34 may be read directly in tenths of said standard length unit (i.e., in tenths of an inch). The peripheral speed of the bit 34 need only be about 50 feet per minute, and this low peripheral drill speed combined with the only momentary contact with a possibly abrasive stratum results in negligible drill bit wear. Comparatively, the peripheral speed of the cutting head 12 is conventionally high—i.e., 600 feet per minute, and this is the peripheral speed of conventional cutting tools for other photoelectric strata sensing apparatus (such as shown in U.S. Pat. No. 3,333,893).

The operator station 55 (see FIG. 4) is remote from the mining machine 10, and control means are provided for controlling operation of the penetrating means 18 in conjunction with the monitoring means 20. The control means preferably includes first circuitry means 56, with mostly solid state components, for determining the distance of movement of the penetrating means (drill bit 34) from a reference point in the direction V to the point where the drill bit 34 penetrates the over-burden; or first circuitry means comparable to means 56 only including the hookup of line 111 shown in dotted line in FIG. 4 rather than the hookup of line 110, for determining the distance of movement of the penetrating means (drill bit 34) from the start of the coal seam A to the point where it penetrates the over-burden B (thus determining the thickness of the coal seam A); and second circuitry means 57 (mostly solid state) operatively connected to the light sensitive means 24 for effecting movement of the penetrating means 18 back toward the machine 10 after penetration of the over-burden. When the apparatus of FIG. 3 is utilized, determination of the distance of movement in direction V is simple, since it is directly proportional to the number of rotations of the drill bit 34 (and/or components rotatively rigidly connected thereto). Thus, the first circuitry means preferably comprises a reed switch 59 and a permanent magnet 60 mounted in the worm gear 38, each rotation of the gear 38 resulting in the magnet 60 passing the reed switch 59 once, and effecting operation thereof. The first circuitry means further comprises a conventional digital counter 62 for counting the number of rotations of the gear 38 in a given sequence and digitally displaying that number.

Figure 4:
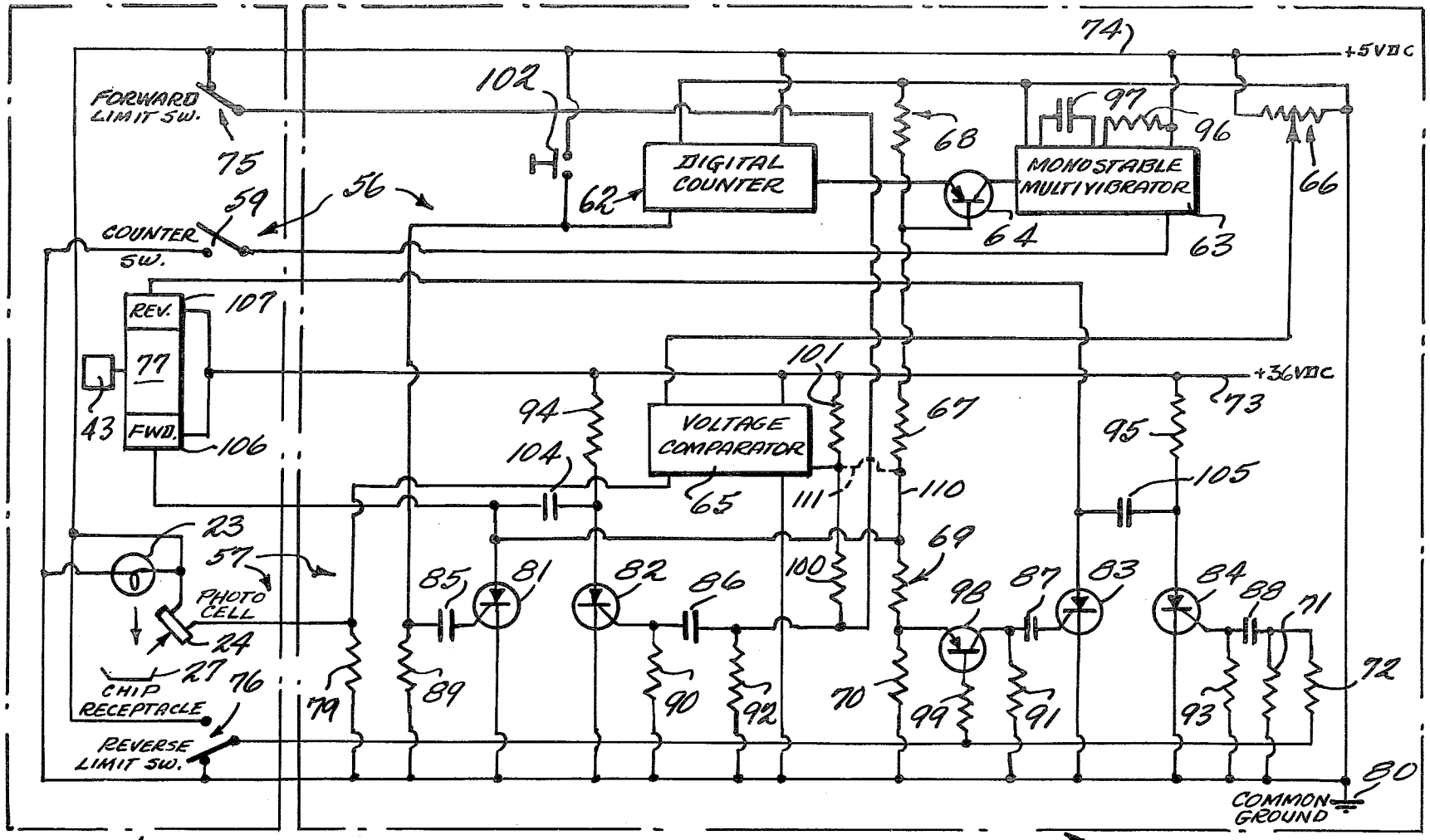
FIG. 4 is an electrical schematic of exemplary control circuitry according to the invention.

FIG. 4 shows one exemplary circuitry arrangement that is desirable for use with apparatus of FIG. 3. The circuit of FIG. 4 includes a digital counter 62, a monostable multi-vibrator 63 which emits a pulse through transistor 64 to the digital counter 62 each time reed switch 59 is closed, the multi-vibrator 63 insuring that only one pulse is delivered to the counter 62 for each revolution; a voltage comparator 65 for comparing the voltage delivered from photocell 24 to a reference voltage, and a potentiometer 66 for adjusting the reference voltage which the voltage comparator 65 compares to the voltage from the photocell 24. Four different voltage dividers are provided by resistors 67, 68; 69, 70; 71, 72; and 92, 100. Line 73 is the main power line while line 74 is an accessory power line for the lamp 23 and photocell 24. Forward and reverse limit switches 75, 76 are operatively connected to line 74, the limit switches being mounted on the mining machine for cooperation with the drill tube 45. While such switches are not shown in FIG. 3, it will be understood that any conventional actuators for limit switches may be provided associated with the structure of FIG. 3.

Main power line 73 is connected up to solenoid valve 77 which controls the reversible motor 43 for rotating power shaft 42, valve 77 having a forward solenoid 106 and a reverse solenoid 107.

Resistor 79 is connected in parallel with voltage comparator 65, and ultimately to the common ground 80. Four SCRs 81, 82, 83 and 84 respectively are connected up to various of the circuitry components and ultimately to ground 80. Gate capacitors 85, 86, 87 and 88 are associated with the respective SCRs, charging current for these capacitors being provided by the voltage drop across resistors 89, 92, 91 and 71 respectively. Resistors 90 and 93 serve to expedite the discharge of capacitors 86 and 88 respectively. Resistors 94 and 95 respectively provide a small current from main line 73 to SCRs 82, 84, respectively, to maintain them in a conducting state in the absence of gate current. Resistor 96 and capacitor 97 determine the duration of pulses from the multivibrator 63. Transistor 98 serves to prevent SCR 83 from being turned on simultaneously with SCR 84 when conductor 73 is first connected to the 36 VDC power supply. Resistor 99 returns the base of transistor 98 to ground when the reverse limit switch goes to ground, thus permitting transistor 98 to conduct. Pushbutton 102 starts the measuring sequence.

When the effective measuring by the means 16 of the distance of the mining machine 10 from the over-burden B in the direction V is accomplished by determining the distance between a reference associated with the mining machine 10 and the over-burden B, the line 110 connection shown in solid line in FIG. 4 is utilized. However, under some circumstances it is desirable to accomplish the effective measurement of the machine 10 from the overburden B in the direction V by determining the thickness of the coal seam A. This is accomplished merely by providing the line 111 connection, shown in dotted line in FIG. 4, instead of the line 110 connection, so that resistor 67 is connected up to the bottom of resistor 101 instead of to the top of resistor 69.

Apparatus according to the present invention having been described, a mode of operation thereof will now be set forth.

Mining machine 10 is moved into the coal seam A in direction H, the cutting portions 12, 14, effecting cutting of the coal seam A. After penetration of the seam a predetermined distance, the mining machine 10 is stopped, and the machine operator at the operator station 55 depresses the start-push button 102 of the control circuitry (see FIG. 4). At the time the start-push button 102 is depressed, the forward limit switch 75 is open, the reed switch 59 is open, the solenoid valve 77 is not energized, the light source 53 is energized, the photocell 24 is receiving light reflected off of the surface 28 of chip receptacle 27, reverse limit switch 76 is at 5 volts DC, SCRs 81 and 83 are off and 82 and 84 are conducting, transistors 64 and 98 are in their blocking states, the internal solid state switch in the voltage comparator 65 is open, and the digital counter 62 shows the extent of drill penetration from the previous cycle.

Once the start-push button 102 is depressed, the SCR 81 is turned on and SCR 82 is turned off by the commutating action of capacitor 81, the digital counter 62 is reset to 0, and the forward solenoid 106 of solenoid valve 77 is energized which causes motor 43 to turn shaft 42 in the forward direction. Shaft 42 acts through worm 40 and worm gear 38 to rotate drive tube 36, which is operatively connected to drill tube 45 through the keying means 46, 47. Drill tube 45 also moves linearly in direction V as it rotates since the internal threads on threaded bushing 49 thereof cooperate with the threads on fixed rod 50, the keying means 46, 47 allowing the relative linear movement between the elements 3, 45.

As the drill bit 34 is rotated, permanent magnet 60 will activate reed switch 59 upon each rotation of gear 38. Once SCR 81 is turned on by the depression of start-push button 102, the voltage applied to the base of transistor 64 by the voltage divider 67, 68 is incapable of sustaining transistor 64 in its blocking state. Thus, each time reed switch 59 closes, the multi-vibrator 63 emits a pulse through transistor 64 to digital counter 62, the multi-vibrator 63 insuring that only one pulse is delivered to counter 62 for each revolution of the gear 38.

As the advance of the drill 34 in direction V continues, the reverse limit switch 76 goes to ground permitting transistor 98 to conduct. Even with the limit switch 76 grounded, however, the voltage applied by the voltage divider 69, 70, is insufficient to turn on SCR 83.

Once drill bit 34 penetrates the coal seam A, chips are generated, which chips fall through the chips funnel 25 into the chip collecting bin 27, covering the reflective surface 28 as they slowly fall through opening 29 in chips cup 27. This results in a decrease in the amount of light reflected to the photocell 24 from lamp 23, effecting an increase in the resistance of photocell 24. The increase in resistance of photocell 24 causes the voltage delivered to voltage comparator 65 from the top of resistor 79 to decrease below the reference voltage which has been set by the potentiometer 66. The potentiometer 66 will be adjusted depending upon the relative light reflecting characteristics of the coal seam A and the material of the over-burden B. With the decrease of the voltage supplied from the top of resistor 79 relative to that supplied through potentiometer 66, the comparator 65 connects the junction of resistors 100, 101 to ground, capacitor 86 then discharging through resistors 90, 92.

As rotation of drill bit 34 and advancement in direction V continues, the number of revolutions thereof is counted by the counter 62 until the drill bit 34 hits the over-burden B, at which point chips are generated from the over-burden B and falling through funnel 25 into collecting cup 27. Because of the greater light reflective characteristics of the over-burden chips, photocell 24 receives more light and the resistance thereof decreases, causing the voltage at the top of resistor 70 to again exceed the reference voltage supplied by potentiometer 66. Then the internal solid state switch in voltage comparator 65 opens permitting current to flow from main line 73 to gate capacitor 86, which turns on SCR 82, and through the commutating action of capacitor 104 turns SCR 81 off. This de-energizes the forward solenoid 106, stopping the forward advance of the drill, and increasing the voltage applied by the voltage divider 69, 70 to the gate capacitor 87 turning SCR 83 on, with SCR 84 turned off by the commutating action of capacitor 105. Also, the turning off of SCR 81 increases the voltage applied to the base of transistor 64, returning it to its blocking state and locking in the number of counts in the digital counter 62, preventing any further pulses from counter-switch 59 and multi-vibrator 63 from reaching the counter 62.

When the line 110 connection, shown in solid line in FIG. 4, is employed, the number displayed by the digital counter 62 is a representation of the distance the drill bit 34 has advanced from the reference point to where it contacted over-burden B. However, when the line 111 connection, shown in dotted line in FIG. 4 is employed in place of the line 110 connection, the number displayed by the digital counter 62 is a representation of the distance the drill bit has moved in direction V after contacting coal seam A, or the thickness of the coal seam A. This is because when the line 111 connection is employed the digital counter 62 counts only when the internal solid state switch in voltage comparator 65 connects the junction of the resistors 100 and 101 to ground; this would permit transistor 64 to conduct only while the chips generated by drill bit 34 possess low reflectivity. Preferably, the threads of elements 49, 50 are provided in tenths of a standard unit length so that the digital counter may be read directly in tenths of that standard unit length—for instance, in tenths of an inch.

When SCR 83 is turned on, the reverse solenoid 107 is energized, reversing the direction of rotation of the shaft 42 by the motor 43, and thus moving the drill bit 34 back to its original position. The drill continues to rotate in the reverse direction until the reverse limit switch 76 is actuated thereby applying 5 volts DC to the voltage divider 71, 72, and turning on SCR 84, which turns off SCR 83 through the commutating action of capacitor 105. Turning off SCR 83 de-energizes the reverse solenoid thus terminating power to the drill motor 43. The operator then inspects the effective distance the mining machine is from the over-burden B by viewing the digital counter 62, whether it gives the reading in distance of the over-burden B from a reference, or thickness of the coal seam A over the machine 10, makes any correction to the steering of the mining machine 10 that is necessary, and continues penetration in direction H of the mining machine 10 until the next desired test point is reached. The time consumed by the penetration of the coal seam A and over-burden B in direction V results in only about a one minute delay for each test stop in the continuous mining operation.

It will thus be seen that according to the present invention a method and apparatus have been provided that provide for a simple, safe, and efficient determination of the effective distance of the mining machine from the over-burden, to allow exact control of the mining machine to keep it within the coal seam. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A method of mining a desired geological stratum from surrounding undesired geological strata, the desired and undesired strata having different light reflecting properties, utilizing a mining machine, said method comprising the steps of boring in a first generally horizontal direction into the desired geological stratum with the mining machine, progressively penetrating the desired geological stratum with the mining machine while effectively measuring the distance of the mining machine from the undesired strata in a second generally vertical direction generally perpendicular to said first direction, said measuring being accomplished by taking advantage of the different light reflecting properties of the desired stratum and the surrounding undesired strata, and controlling the direction of boring based on the received measurements so that the machine generally stays within the desired stratum.

2. A method as recited in claim 1 wherein said step of taking advantage of the different light reflecting properties of the desired stratum and the surrounding undesired strata is accomplished by boring through the desired stratum toward and into the undesired strata in said second direction, to generate chips; reflecting light off of the generated chips; and sensing the light reflected off of the generated chips, to provide said received measurements.

3. A method as recited in claim 1 wherein said measuring step is accomplished by determining the distance between a reference point associated with the mining machine and the undesired stratum.

4. A method as recited in claim 1 wherein said measuring step is accomplished by determining the thickness of the desired stratum above the mining machine.

5. A method of mining a desired geological stratum from surrounding undesired geological strata, the desired and undesired strata having different light reflecting properties, utilizing a mining machine, said method comprising the steps of boring in a first direction into the desired geological stratum with the mining machine;

progressively penetrating the desired geological stratum with the mining machine while effectively measuring the distance of the mining machine from the undesired strata in a second direction generally perpendicular to said first direction, said measuring being accomplished by taking advantage of the different light reflecting properties of the desired stratum and the surrounding undesired strata by boring through the desired stratum toward and into the undesired strata in said second direction, to generate chips; reflecting light off of the generated chips; and sensing the light reflected off of the generated chips, to provide said received measurements; and controlling the direction of boring based on the received measurements so that the machine generally stays within the desired stratum.

6. A method as recited in claim 5 wherein the generated chips are collected before light is reflected off them.

7. A method as recited in claim 5 wherein said progressive penetration step in said first direction is accomplished by intermittent penetration, said boring in said second direction taking place during a pause in said penetration in said first direction.

8. A method as recited in claim 5 wherein said step of boring in said second direction is accomplished by rotating a rotary drill with a peripheral speed of about 50 feet/minute.

9. A method as recited in claim 5 wherein said boring in said first direction is accomplished by rotating a cutting head of said mining machine with a high peripheral speed, and said boring in said second direction is accomplished by rotating a rotary drill with a low peripheral speed.

10. A method of mining a desired geological stratum from surrounding undesired strata having different properties, utilizing a mining machine, said method comprising the steps of boring in a first direction into the desired geological stratum with the mining machine, progressively penetrating the desired geological stratum with the mining machine while effectively measuring the distance of the mining machine from the undesired strata in a second direction generally perpendicular to said first direction, said measuring being accomplished by boring through the desired stratum toward and into the undesired strata in said second direction, to generate chips, and continuously monitoring a property of said chips that is different for undesired strata chips than for desired stratum chips, and controlling the direction of boring based upon the received measurements so that the machine generally stays within the desired stratum.

11. A method as recited in claim 10 wherein the property of said strata that is different is the light reflecting characteristics thereof, and wherein said measuring step is further practiced by reflecting light off of chips and sensing the light reflected off of the generated chips to provide said received measurements.

12. Apparatus for mining a desired geological stratum comprising a mining machine having a cutting head thereon, and adapted to penetrate a geological stratum in a first direction, a rotary drill mounted on said mining machine adjacent said cutting head, but posterior thereof, a chips funnel surrounding said rotary drill for guiding the path of movement of chips generated by penetration of said rotary drill into the geological stratum, means for moving said rotary drill into the geological stratum in a second direction generally perpendicular to said first direction, a light source mounted on said machine, a chips collecting cup located at a terminal point of said chips funnel, and comprising a chips background surface, and a photocell mounted in operative relationship with said light source and said chips background surface.

13. Apparatus as recited in claim 12 wherein said rotary drill includes an internally threaded drill tube, and wherein said means for moving said rotary drill in said second direction comprises a fixed externally threaded rod threadingly receiving said drill tube, a drive tube surrounding said drill tube and said rod, and means for effecting rotation of said drill tube upon rotation of said drive tube but allowing for relative longitudinal movement between said drill and drive means.

14. Apparatus as recited in claim 12 further comprising means for counting the number of revolutions of said rotary drill.

15. Apparatus as recited in claim 14 further comprising a gear for rotating said rotary drill, and wherein said means for counting the number of revolutions of said drill comprises a permanent magnet mounted with said gear, and a read switch mounted on said machine and in operative relationship with said permanent magnet.

16. Apparatus for mining a desired geological stratum from surrounding undesired geological strata, the desired and undesired strata having different properties, comprising a mining machine including a cutting head for boring in a first direction into the desired geological stratum, and for progressively penetrating the desired geological stratum, and means for effectively measuring the distance of said mining machine from the undesired strata in a second direction generally perpendicular to said first direction, said measuring means comprising means for penetrating the desired stratum toward and into the undesired strata in said second direction to generate chips, and means for continuously monitoring a property of the chips generated that is different for undesired strata chips than for desired stratum chips.

17. Apparatus as recited in claim 16 wherein said means for continuously monitoring a property of the generated chips comprises a light source, a chips collecting means and light sensitive means positioned so as to receie light reflected off chips in said chips collecting means.

18. Apparatus as recited in claim 17 further comprising control means for controlling operation of said penetrating means in conjunction with said continuously monitoring means, said control means comprising first circuitry means for determining the thickness of said desired stratum, and second circuitry means operatively connected to said light sensitive means for effecting movement of said penetrating means back toward said machine after penetration of said undesired strata.

19. Apparatus as recited in claim 17 further comprising control means for controlling operation of said penetrating means in conjunction with said continuously monitoring means, said control means comprising first circuitry means for determining the distance of movement of said penetrating means from a reference point in said second direction to the point where the penetrating means penetrates said undesired strata, and second circuitry means operatively connected to said light sensitive means for effecting movement of said penetrating means back toward said reference after penetration of said undesired strata.

20. Apparatus as recited in claim 19 wherein said penetrating means includes a rotatable drive and means for transforming rotation of the drive into linear movement of said penetrating means in said second direction and wherein said first circuitry means comprises a reed switch and a solid-state digital counter, said reed switch activated during each revolution of said penetrating means rotatable drive.

21. Apparatus as recited in claim 17 wherein said chips collecting means comprises a chips funnel surrounding said penetrating means, and a collecting cup having a reflective surface positioned at the termination of said chip funnel.

22. Apparatus as recited in claim 16 wherein said penetrating means comprises a rotary drill bit, means for rotating said drill bit, and means for linearly moving said drill bit in said second direction.

23. Apparatus as recited in claim 22 wherein said means for rotating said drill bit comprises a drive tube operatively connected to said drill bit, a gear connected to said drive tube, and a power source operatively connected to said gear.

24. Apparatus as recited in claim 23 wherein said gear comprises a worm gear and wherein said power source is operatively connected to said worm gear through a worm.

25. Apparatus as recited in claim 23 wherein said drill bit is operatively connected to said drive tube by spline means and a drill tube, and wherein said means for linearly moving said drill bit comprises internal threading on said drill tube, and a fixed externally threaded rod in engagement with said threads of said drill tube.

26. Apparatus as recited in claim 25 wherein said threaded rod has 10 threads per standard length unit, and further comprising digital counting means for counting the number of revolutions of said drill bit, said counting means reading directly in tenths of said standard length unit.

27. Apparatus as recited in claim 22 wherein a single power source is provided for effecting rotation and linear movement of said drill bit.

* * * * *